US011105057B2

(12) United States Patent
Hopwood

(10) Patent No.: US 11,105,057 B2
(45) Date of Patent: Aug. 31, 2021

(54) MAGNETIC BAR FOR PICKUP HEAD OF SWEEPER TRUCK

(71) Applicant: William J. Hopwood, Jefferson, MD (US)

(72) Inventor: William J. Hopwood, Jefferson, MD (US)

( * ) Notice: Subject to any disclaimer, the term of this patent is extended or adjusted under 35 U.S.C. 154(b) by 395 days.

(21) Appl. No.: 15/877,139

(22) Filed: Jan. 22, 2018

(65) Prior Publication Data

US 2019/0226169 A1 Jul. 25, 2019

(51) Int. Cl.

| | |
|---|---|
| ***E01H 1/14*** | (2006.01) |
| ***E01H 1/10*** | (2006.01) |
| ***E01H 1/08*** | (2006.01) |
| ***B03C 1/035*** | (2006.01) |
| ***B03C 1/033*** | (2006.01) |
| *B03C 1/30* | (2006.01) |

(52) U.S. Cl.

CPC ..... *E01H 1/14* (2013.01); *B03C 1/035* (2013.01); *B03C 1/0332* (2013.01); *B03C 1/0335* (2013.01); *E01H 1/0845* (2013.01); *E01H 1/103* (2013.01); *B03C 1/30* (2013.01); *B03C 2201/30* (2013.01)

(58) Field of Classification Search

CPC ..... B03C 1/30; B03C 1/035; B03C 1/0335; B03C 1/0332; B03C 2201/30; E01H 1/08; E01H 1/0827; E01H 1/0845; E01H 1/103; E01H 1/14

See application file for complete search history.

(56) References Cited

U.S. PATENT DOCUMENTS

| | | | | |
|---|---|---|---|---|
| 2,818,176 | A * | 12/1957 | Polich | B03C 1/30 209/215 |
| 2,937,713 | A | 5/1960 | Stephenson et al. | |
| 3,934,373 | A | 1/1976 | Leliaert et al. | |
| 3,956,111 | A * | 5/1976 | Manfredi | B03C 1/06 209/215 |
| 4,020,597 | A | 5/1977 | Shigyo et al. | |
| 4,225,429 | A * | 9/1980 | Holley | B03C 1/16 104/279 |
| 4,593,497 | A | 6/1986 | O'Dell et al. | |
| 5,419,006 | A * | 5/1995 | Duthie | E01H 1/0827 15/326 |
| 5,481,983 | A | 1/1996 | Guzman et al. | |

(Continued)

FOREIGN PATENT DOCUMENTS

| | | |
|---|---|---|
| CN | 203429588 U | 2/2014 |
| EP | 0418425 A1 | 3/1991 |
| GB | 2198930 A | 6/1988 |

OTHER PUBLICATIONS

How Airports Chase Birds Off the Runway; Dated: Aug. 18, 2017; pp. 11.

(Continued)

*Primary Examiner* — Charles A Fox
*Assistant Examiner* — Kalyanavenkateshware Kumar
(74) *Attorney, Agent, or Firm* — Lowe Graham Jones PLLC

(57) ABSTRACT

Embodiments are directed to a street sweeper. The street sweeper may include a hopper, a pickup head, and a magnet bar. The pickup head may have an intake portion that is fluidly coupled to the hopper. The magnet bar may be disposed rearward of the intake portion of the pickup head.

18 Claims, 9 Drawing Sheets

(56) References Cited

U.S. PATENT DOCUMENTS

| | | | | |
|---|---|---|---|---|
| 9,336,936 | B1 * | 5/2016 | Smith | B61F 19/06 |
| 9,598,117 | B1 * | 3/2017 | Hilburn | B62D 25/188 |
| 9,845,856 | B2 * | 12/2017 | Gutteridge | E01H 1/0854 |
| 10,711,416 | B2 * | 7/2020 | Glubrecht | E01H 1/0845 |

OTHER PUBLICATIONS

The Fodbuster FOD Sweeper—The FOD Control Coporation; Dated: Nov. 11, 2017; pp. 5.

* cited by examiner

MAGNETIC BAR FOR PICKUP HEAD OF SWEEPER TRUCK

FIELD OF THE INVENTION

The present invention relates to street sweepers and, more particularly, to removal of ferrous materials from road surfaces.

BACKGROUND OF THE INVENTION

Street sweeper trucks typically employ vacuums to pull debris into hoppers on the trucks. The vacuums often fail to pick up heavier (e.g., denser) debris. The heavier debris (in particular, the metal debris) can lodge in the tires of the trucks, causing flats. Thus, it is with regard to these considerations and others that the present invention has been made.

BRIEF DESCRIPTION OF THE DRAWINGS

Non-limiting and non-exhaustive embodiments of the present innovations are described with reference to the following drawings. In the drawings, like reference numerals refer to like pans throughout the various figures unless otherwise specified. For a better understanding of the described innovations, reference will be made to the following Detailed Description of the Various Embodiments, which is to be read in association with the accompanying drawings, wherein.

SUMMARY OF THE INVENTION

Figure 1:
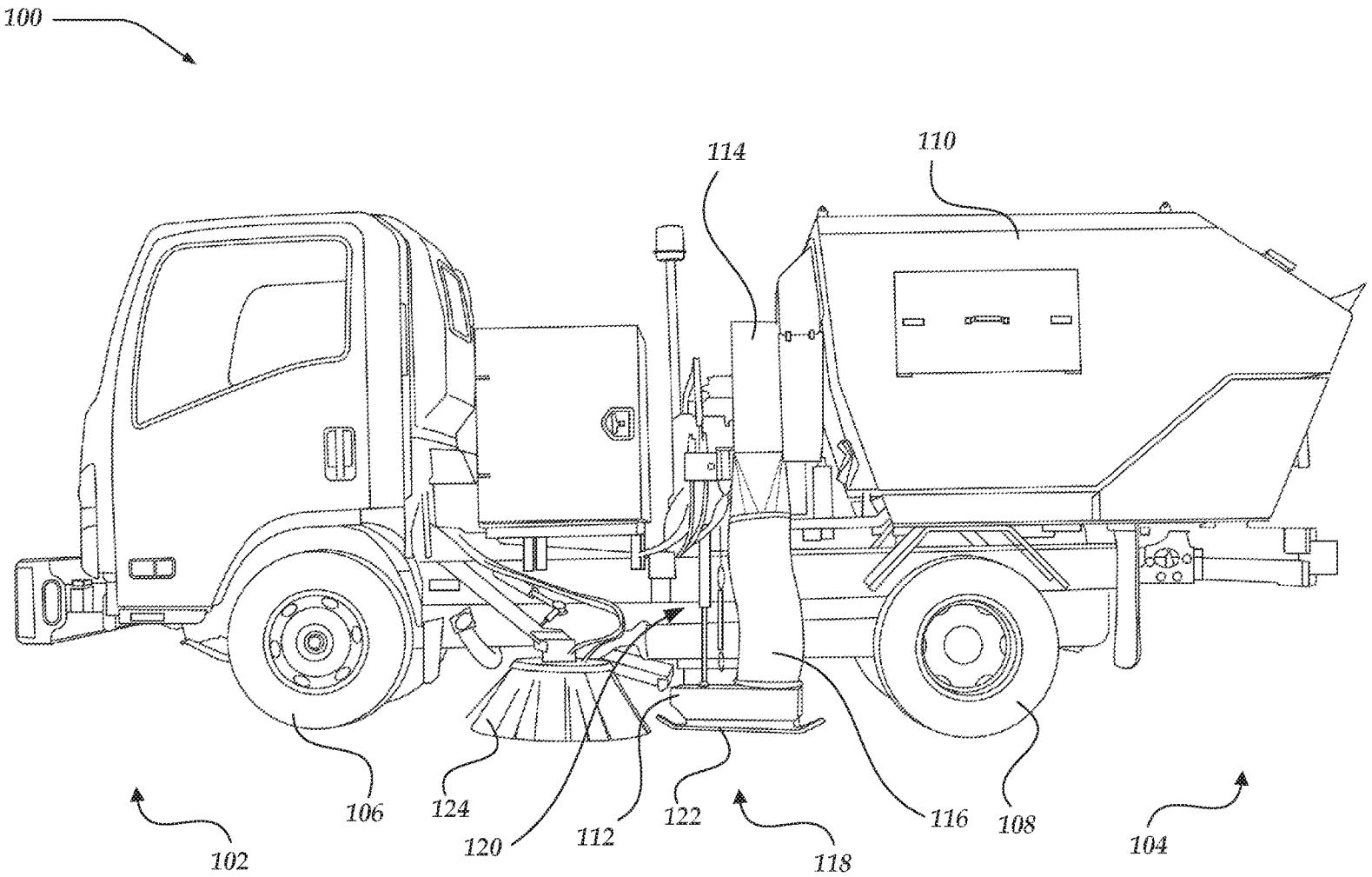
FIG. 1 illustrates a perspective blower-side view of an example sweeper truck having a pickup head.

The following briefly describes example embodiments of the invention in order to provide a basic understanding of some aspects of the invention. This brief description is not intended as an extensive overview. It is not intended to identify key or critical elements or to delineate or otherwise narrow the scope. Its purpose is merely to present some concepts in a simplified form as a prelude to the more detailed description that is presented later.

Briefly stated, various embodiments are directed to a street sweeper. In one or more of the various embodiments, the street sweeper may include a hopper, a pickup head, and a magnet bar. In some of the various embodiments, the pickup head may have an intake portion that is fluidly coupled to the hopper. In some embodiments, the magnet bar may be disposed rearward of the intake portion of the pickup head.

In some embodiments, the magnet bar may be mechanically coupled to the pickup head.

In some embodiments, the intake portion of the pickup head may have an intake aperture. In some embodiments, the magnet bar may be laterally aligned with the intake aperture of the intake portion of the pickup head.

In some embodiments, the pickup head may have a width. In some embodiments, the magnet bar may have a width that is less than half the width of the pickup head.

In some embodiments, the street sweeper may further include a rear wheel disposed rearward of the pickup head. In some embodiments, the magnet bar may be disposed forward of the rear wheel. In some embodiments, the magnet bar may be laterally aligned with the rear wheel.

In some embodiments, the street sweeper may further include one or more rear wheels disposed rearward of the pickup head. In some embodiments, the one or more rear wheels may be laterally aligned with the intake portion of the pickup head. In some embodiments, the one or more rear wheels may have a combined width. In some embodiments, the magnet bar may be disposed forward of the one or more rear wheels. In some embodiments, the magnet bar may be laterally aligned with the one or more rear wheels. In some embodiments, the magnet bar may have a width that is less than double the combined width of the one or more rear wheels.

In some embodiments, the pickup head may have a blower portion that is fluidly coupled to a blower. In some embodiments, the blower portion of the pickup head may lack the magnet bar.

In some embodiments, the magnet bar may include a magnet case. In some embodiments, the magnet bar may include a magnet disposed in the magnet case. In some embodiments, the magnet bar may include a bracket. In some embodiments, the bracket may be mechanically coupled to the magnet case and may be mechanically coupled to the intake portion of the pickup head with the magnet case disposed rearward of the intake portion of the pickup head.

In some embodiments, the magnet bar may include a magnet case. In some embodiments, the magnet bar may include a magnet disposed in the magnet case. In some embodiments, the magnet bar may include a bracket. In some embodiments, the bracket may be mechanically coupled to the magnet case and may be mechanically coupled to the intake portion of the pickup head with the magnet case disposed rearward of the intake portion of the pickup head. In some embodiments, the magnet bar may include an end cap. In some embodiments, the end cap may be disposed at a lateral end portion of the magnet case. In some embodiments, one or more portions of the end cap may be aligned with one or more portions of the bracket.

In some embodiments, the magnet bar may include a magnet case. In some embodiments, the magnet bar may include a magnet disposed in the magnet case. In some embodiments, the magnet bar may include a bracket. In some embodiments, the bracket may be mechanically coupled to the magnet case and may be mechanically coupled to the intake portion of the pickup head with the magnet case disposed rearward of the intake portion of the pickup head. In some embodiments, the magnet bar may include an end cap. In some embodiments, the end cap may be disposed at a lateral end portion of the magnet case. In some embodiments, the magnet bar may include a case fastener. In some embodiments, the case fastener may mechanically couple the bracket and the end cap.

In some embodiments, the magnet bar may include a magnet case. In some embodiments, the magnet bar may include an array of magnets disposed in the magnet case. In some embodiments, the magnet bar may include a keeper plate. In some embodiments, the keeper plate may be disposed in the magnet case and magnetically coupled to each magnet in the array of magnets.

Also, briefly stated, various embodiments are directed to a magnet bar for a street sweeper having a pickup head pulling a vacuum, the pickup head having a forward side and a rearward side. In one or more of the various embodiments, the magnet bar may include a magnet case, a magnet, and a bracket. In some of the various embodiments, the magnet may be disposed in the magnet case. In some embodiments, the bracket may be mechanically coupled to the magnet case. In some embodiments, the bracket may be adapted to mechanically couple the magnet case to an intake portion of the pickup head of the street sweeper with the magnet case disposed rearward of the intake portion of the pickup head.

In some embodiments, the intake portion of the pickup head may have an intake aperture. In some embodiments, the bracket may be adapted to mechanically couple the magnet case to the intake portion of the pickup head with the magnet case laterally aligned with the intake aperture of the intake portion of the pickup head.

In some embodiments, the pickup head may have a width. In some embodiments, the magnet case may have a width that is less than half the width of the pickup head.

In some embodiments, the street sweeper may have a rear wheel disposed rearward of the pickup head. In some embodiments, the bracket may be adapted to mechanically couple the magnet case to the intake portion of the pickup head with the magnet case laterally aligned with the rear wheel.

In some embodiments, the street sweeper may have one or more rear wheels disposed rearward of the pickup head. In some embodiments, the one or more rear wheels may be laterally aligned with the intake portion of the pickup head. In some embodiments, the one or more rear wheels may have a combined width. In some embodiments, the magnet case may have a width that is less than double the combined width of the one or more rear wheels.

In some embodiments, the magnet bar may further include an end cap. In some embodiments, the end cap may be disposed at a lateral end portion of the magnet case. In some embodiments, one or more portions of the end cap may be aligned with one or more portions of the bracket.

In some embodiments, the magnet bar may further include an end cap. In some embodiments, the end cap may be disposed at a lateral end portion of the magnet case. In some embodiments, the magnet bar may further include a case fastener. In some embodiments, the case fastener may mechanically couple the bracket and the end cap.

In some embodiments, the magnet bar may further include another magnet disposed in the magnet case. In some embodiments, the magnet and the other magnet may be arranged in an array of magnets. In some embodiments, the magnet bar may further include a keeper plate. In some embodiments, the keeper plate may be disposed in the magnet case and may be magnetically coupled to each magnet in the array of magnets.

In some embodiments, the magnet bar may further include a cushion. In some embodiments, the cushion may be disposed in the magnet case. In some embodiments, the cushion may be in physical contact with the magnet.

DETAILED DESCRIPTION OF THE VARIOUS EMBODIMENTS

The various embodiments now will be described more fully hereinafter with reference to the accompanying drawings, which form a part hereof and show, by way of illustration, specific example embodiments by which the invention may be practiced. The embodiments may, however, be embodied in many different forms and should not be construed as limited to the embodiments set forth herein; rather, these embodiments are provided so that this disclosure will be thorough and complete and will fully convey the scope of the embodiments to those skilled in the art. Among other things, the various embodiments may be methods, systems, or devices. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments may be readily combined, without departing from the scope or spirit of the invention.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise. In addition, the meaning of "a," "an," and "the" include plural references. Also, plural references are intended to also disclose the singular, unless the context clearly dictates otherwise. The meaning of "in" includes "in" and "on." Also, the use of "when" and "responsive to" do not imply that associated resultant actions are required to occur immediately or within a particular time period. Instead, they are used herein to indicate actions that may occur or be performed in response to one or more conditions being met, unless the context clearly dictates otherwise.

FIG. 1 illustrates a perspective blower-side view of example street sweeper truck 100. Truck 100 may have a chassis with front end portion 102, rear end portion 104, and a longitudinal length that extends from front end portion 102 to rear end portion 104. In one or more of the various embodiments, truck 100 may have one or more front wheels and tires 106 rotatably coupled to the chassis, one or more rear wheels and tires 108 rotatably coupled to the chassis, and hopper 110 mechanically coupled to the chassis. In some of the various embodiments, truck 100 may have pickup hopper 110 that is mechanically coupled to the chassis and disposed between front tires 106 and rear tires 108. In some embodiments, truck 100 may include blower 114 and blower tube 116. Blower tube 116 may fluidly couple blower 114 to blower side portion 118 of pickup head 112, thereby facilitating emitting air from the bottom of blower side portion 118 of pickup head 112. In some embodiments, truck 100 may include one or more chassis couplers 120 that mechanically couple pickup head 112 to the chassis of truck 100. In some embodiments, each chassis coupler 120 may have an adjustable length (for example, hydraulic cylinders, one or more springs, telescoping shocks, or others) (see FIG. 1), thereby facilitating pickup head 112 moving up or down relative to the chassis of truck 100 when the pickup head is deployed for operation or responsive to variances in the terrain of the street (for example, speed bumps). In other embodiments, each chassis coupler 120 may have a fixed length (for example, one or more beams or others) (see FIG. 3).

In one or more of the various embodiments, pickup head 112 may include one or more skis or skid plates 122 that facilitate protecting pickup head 112 from variances in the terrain of the street (for example, speed bumps). In some of the various embodiments, skid plate 122 has one or more of a front upwardly curved tip or a rear upwardly curved tip, thereby facilitating protecting the pickup head 112 when truck 100 moves forward or rearward. In some embodiments, truck 100 may include one or more fluid sprayers (for example, one or more water sprayers) or active (for example, rotating) or passive (for example, fixed) brushes 124 or that facilitate agitating or loosening debris on a street or moving debris toward pickup head 112.

Figure 2:
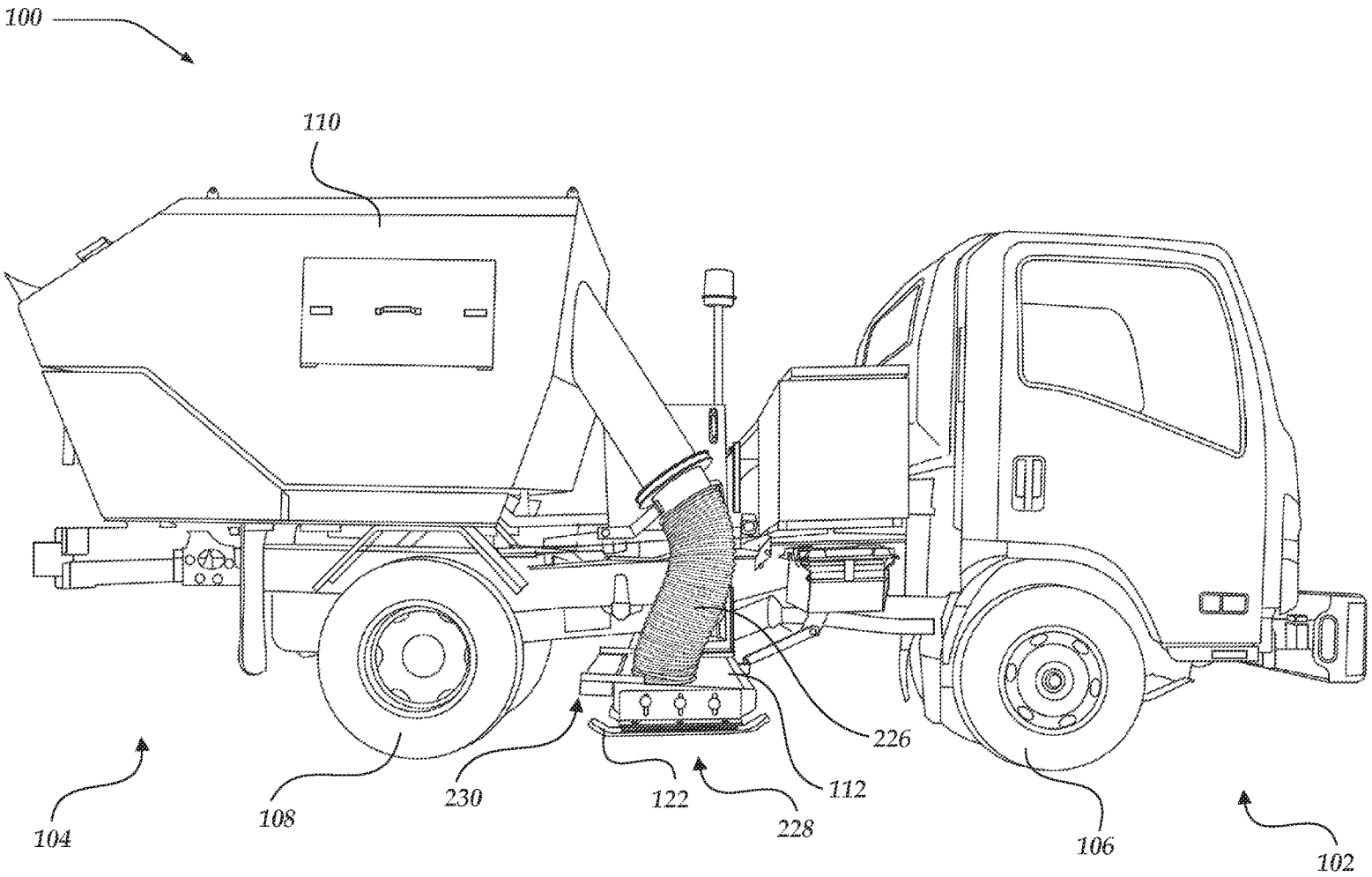
FIG. 2 shows t perspective intake-side view of the truck of FIG. 1, including a magnet bar coupled to the pickup head.

FIG. 2 shows a perspective intake-side view of truck 100. In one or more of the various embodiments, truck 100 may include a vacuum (for example, a vacuum disposed in hopper 110) and intake tube 226 that fluidly couples the vacuum or the interior of hopper 110 to intake side portion 228 of pickup head 112, thereby facilitating sucking air from the bottom of intake side portion 228 of pickup head 112 into hopper 110. Blower 114 preferably creates a vacuum as it pulls air from hopper 110 and thus creates a vacuum in intake tube 226. Accordingly, in some of the various embodiments, truck 100 may employ positive air pressure on blower side portion 118 of pickup head 112 to push debris toward intake side portion 228 of pickup head 112 and may employ negative air pressure on intake side portion 228 of pickup head 112 to suck debris through pickup head 112 and intake tube 226 and into hopper 110. As shown in FIG. 2, truck 100 may include one or more magnet bars 230 mechanically coupled to pickup head 112. Accordingly, in some embodiments, each magnet bar 230 may move vertically with pickup head 112, thereby facilitating reducing the likelihood that variances in the terrain of the street damage each magnet bar 230 or reducing the variance in the distance between each magnet bar 230 and the street surface.

In one or more of the various embodiments, one or more magnet bars 230 may be disposed on the rear side of pickup head 112, thereby facilitating attracting and picking up debris (for example, ferromagnetic or paramagnetic debris) that failed to be sucked through intake lube 226. In some of the various embodiments, one or more magnet bars 230 may be disposed in front of and laterally aligned with one or more tires 108 (for example, being disposed on the same longitudinal path of travel as one or more tires 108 or over the driving path of one or more tires 108), thereby facilitating attracting and picking up ferromagnetic or paramagnetic debris that one or more tires 108 otherwise would have run over. Accordingly, each magnet bar 230 may facilitate reducing the frequency that truck 100 incurs flat tires.

Figure 3:
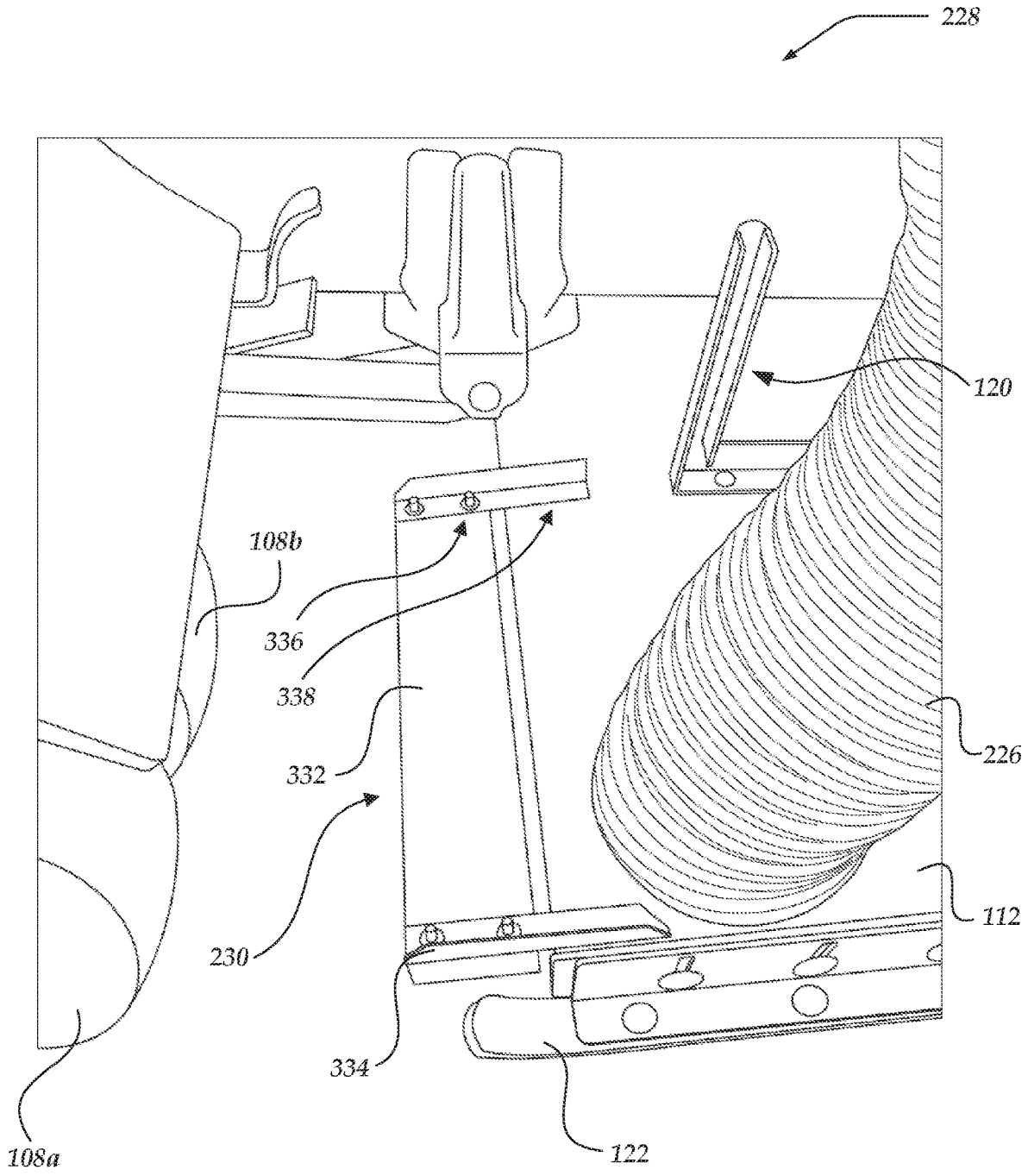
FIG. 3 illustrates a top perspective view of the magnet bar of FIG. 2.

FIG. 3 illustrates a top perspective view of magnet bar 230. As shown in the example of FIG. 3, magnet bar 230 may be laterally aligned with the intake aperture in pickup head 112 with which intake tube 226 fluidly couples. For example, magnet bar 230 may be disposed on the same longitudinal path of travel as one or more of the intake aperture or the end portion of intake tube 226 that mechanically couples to intake side portion 228 of pickup head 112 or over the driving path of the intake aperture. In one or more of the various embodiments, magnet bar 230 may have a width that matches or exceeds a width of each rear tire 108 at intake side portion 228. For example, magnet bar 230 may have a width that matches or exceeds the combined width of outer rear tire 108*a* and inner rear tire 108*b*, measured as a width that extends from an outer face of outer rear tire 108*a* to an inner face of inner rear tire 108*b* (for example, the width of magnet bar 230 may match or exceed the sum of the width of outer rear tire 108*a*, the width of inner rear tire 108*b*, and the distance between outer rear tire 108*a* and inner rear tire 108*b*). In some of the various embodiments, magnet bar 230 may include one or more magnet cases 332 and one or more brackets 334 that mechanically couple each magnet case 332 to pickup head 112. In some embodiments, one or more case fasteners 336 (for example, one or more welds, clamps, detents, bolts with washers or lock nuts, or other fasteners) may fasten each bracket 334 to one or more magnet cases 332. In some embodiments, one or more head fasteners 338 (for example, one or more welds, clamps, detents, bolts with washers or lock nuts, or other fasteners) may fasten each bracket 334 to pickup head 112. Accordingly, in some embodiments, one or more magnet bars 230 may be mechanically coupled in a retrofit to pickup head 112.

Figure 4:
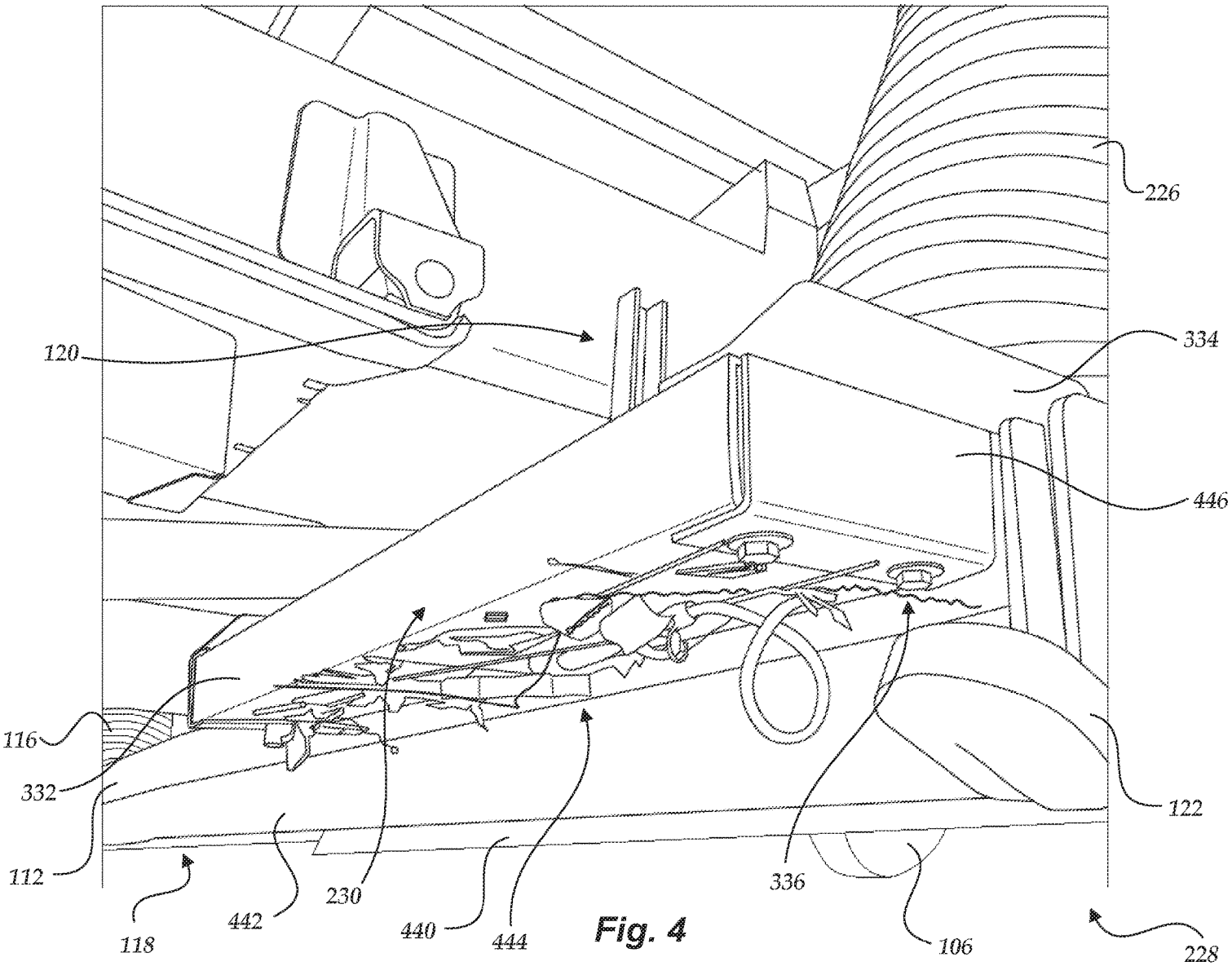
FIG. 4 shows a bottom perspective view of the magnet bar of FIG. 2.

FIG. 4 shows a rearward bottom perspective view of magnet bar 230 coupled to pickup head 112. In one or more of the various embodiments, pickup head 112 may have one or more skirts, such as front skirt 440 or rear skirt 442, thereby facilitating increasing the effectiveness of employing air pressure differentials to move debris from blower side portion 118 to intake side portion 228 and to suck the debris up through intake side portion 228 of pickup head 112. In some of the various embodiments, disposing magnet bar 230 at the rear side of pickup head 112 facilitates attracting and picking up ferromagnetic or paramagnetic debris that rear skirt 442 passes over. Accordingly, in some embodiments, because magnet bar 230 may be disposed at the rear side of pickup head 112 and because the regenerative air system of truck 100 may blow debris from blower side portion 118 to intake side portion 228, magnet bar 230 may have a shorter width to provide a given level of protection to tires 108, at least in comparison to magnet bar 230 being disposed in front of pickup head 112 where magnet bar 230 should attract and pickup ferromagnetic or paramagnetic debris across the entire width of pickup head 112 to provide the given level of protection. Moreover, in some embodiments, because magnet bar 230 may be disposed at the rear side of pickup head 112 and because truck 100 may suck up debris through intake side portion 228, magnet bar 230 may require maintenance (for example, clearing off accumulated ferromagnetic or paramagnetic debris 444) less often, at least in comparison to magnet bar 230 being disposed in front of pickup head 112 where magnet bar 230 may accumulate ferromagnetic or paramagnetic debris that may be light enough to be sucked up at intake side portion 228 of pickup head 112.

In one or more of the various embodiments, magnet bar 230 may include one or more end caps 446 disposed at each end of magnet case 332. In some of the various embodiments, one or more case fasteners 336 may mechanically couple each end cap 446 to magnet case 332. For example, one or more case fasteners 336 that mechanically couple one or more brackets 334 to magnet case 332 may also mechanically couple one or more end caps 446 to magnet case 332.

Figure 5:
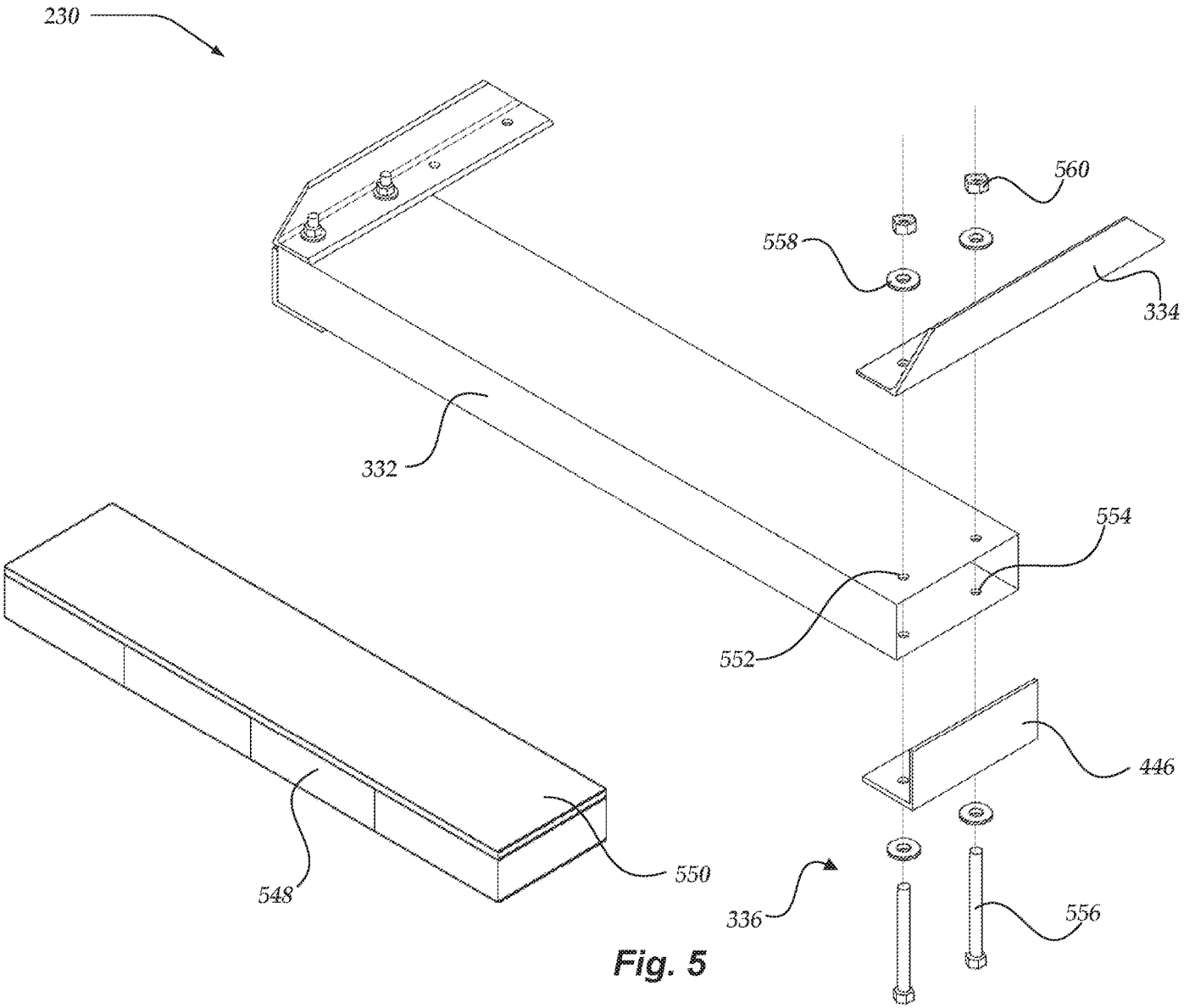
FIG. 5 illustrates a partially exploded, top isometric view of the magnet bar of FIG. 2.

FIG. 5 illustrates a top isometric view of magnet bar 230, with several components of magnet bar 230 separated from each other. In one or more of the various embodiments, magnet bar 230 may include an array of magnets 548 (for example, one, two, three, four, five, six, seven, eight, or more magnets 548). In some of the various embodiments, magnets 548 may be arranged in the array to facilitate augmenting the magnetic field on one or more sides of the array or to facilitate at least partially canceling the magnetic field on one or more sides of the array. For example, in some embodiments, magnets 548 may be arranged in a Halbach array. In other embodiments, magnets 548 may each have the same orientation, such as one of north or south facing to the right side of truck 100 and the other facing to the left side of truck 100. In some embodiments, magnets 548 may include permanent magnets, such as ceramic magnets (for example, grade 8 ceramic magnets), or may include electromagnetic coils or others.

In one or more of the various embodiments, magnet bar 230 may include one or more keeper plates 550 to which one or more magnets 548 magnetically couple. In some of the various embodiments, the entire array of magnets 548 may magnetically couple to one keeper plate 550, thereby facilitating moving the array as a single unit. In some embodiments, each keeper plate 550 may include a magnet keeper, thereby facilitating preserving the strength of magnets 548. In some embodiments, one or more cushions may be disposed above keeper plate 550 (for example, opposite keeper plate 550 from one or more magnets 548), below one or more magnets 548 (for example, opposite one or more magnets 548 from keeper plate 550), or between keeper plate 550 and one or more magnets 548, thereby facilitating absorbing impact or reducing the likelihood of fracturing one or more magnets 548 In some embodiments, keeper plate 550 may include steel, soft iron, or other materials. In some embodiments, the one or more cushions may include one or more closed or open celled foams, such as closed-cell extruded polystyrene foam (XPS).

In one or more of the various embodiments, one or more brackets 334 may include one or more sections of angle iron, thereby facilitating protecting one or more case or head fasteners 336, 338. In some of the various embodiments, one or more end caps 446 may have an L-shape or a U-shape, thereby facilitating providing one or more faces that mechanically couple to magnet case 332 and a face that secures the magnet array in magnet case 332. In the example shown in FIG. 5, each end cap 446 has an L-shape with a bottom face that mechanically couples to the bottom surface of magnet case 332 and a side face that covers an end opening in magnet case 332. In other examples, one or more U-shaped end caps 446 may be arranged similarly to L-shaped end caps 446 with an additional top face that mechanically couples to the top surface of magnet case 332. In some embodiments, one or more brackets 334 may be disposed above one or more portions of one or more end caps 446, thereby facilitating employing the same one or more case fasteners 336 to mechanically couple one or more brackets 334 and one or more end caps 446 to magnet case 332. For example, one or more bolts may extend through one or more apertures in bracket 334, one or more apertures in magnet case 332, and one or more apertures in one or more top faces or bottom faces of one or more end caps 446. In other embodiments, one or more brackets 334 may be inset from one or more end caps 446.

In the example shown in FIG. 5, each end portion of magnet case 332 has one or more top apertures 552 and one or more bottom apertures 554. In one or more of the various embodiments, one or more top apertures 552 may be horizontally aligned with one or more corresponding bottom apertures 554, thereby facilitating one or more case fasteners 336 extending through both one or more top apertures 552 and one or more bottom apertures 554. In some of the various embodiments, one or more case fasteners 336 may include one or more bolts 556, washers 558, and one or more nuts 560, such as one or more lock nuts.

Figure 6:
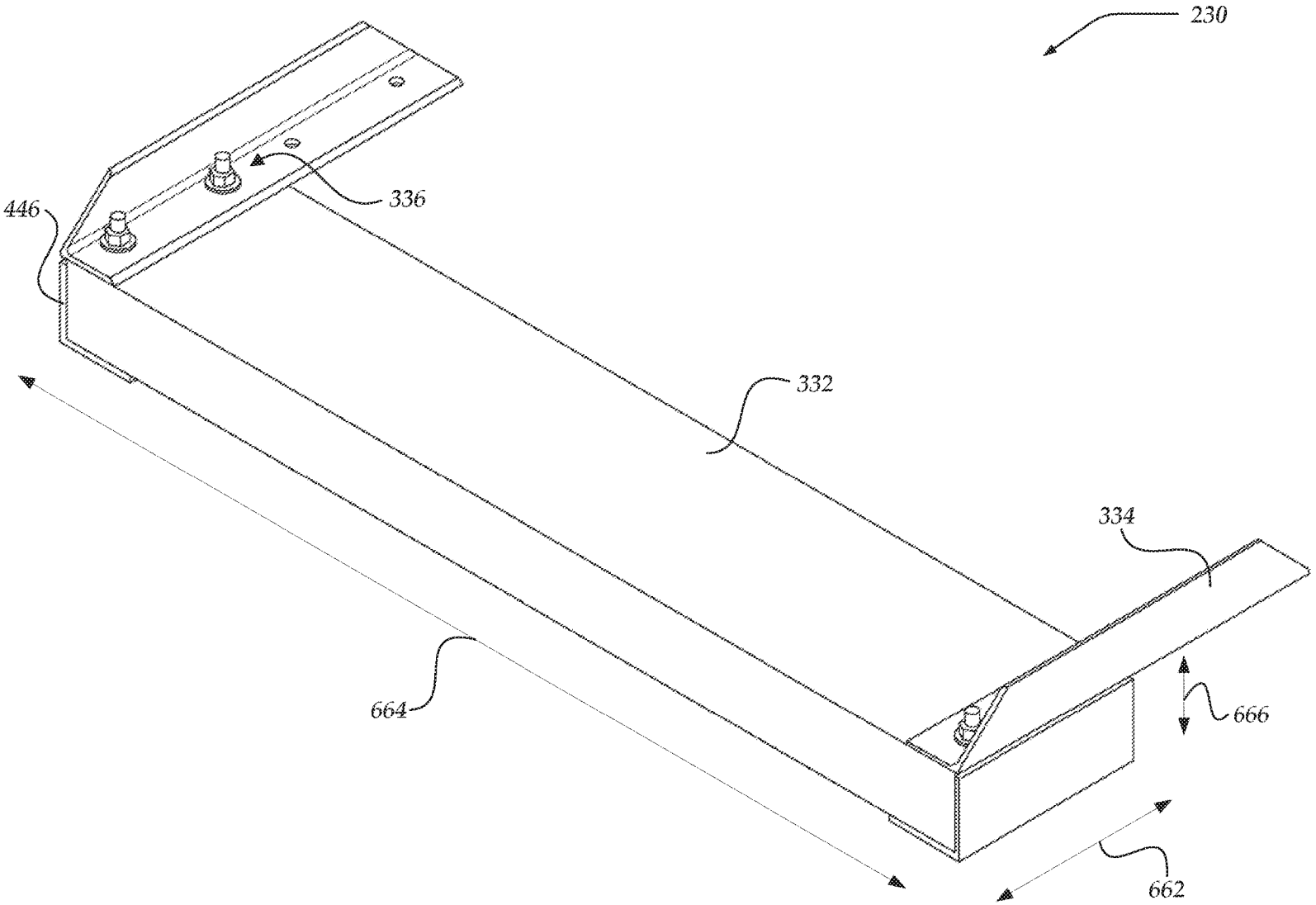
FIG. 6 shows a top isometric view of the magnet bar of FIG. 2, with the components assembled.

FIG. 6 shows a top isometric view of magnet bar 230, with the components of magnet bar 230 assembled together. In one or more of the various embodiments, the array of magnets 548, along with one or more keeper plates 550 or cushions may be inserted into magnet case 332, and one or more end caps 446 may be mechanically coupled to magnet case 332, thereby facilitating reducing the amount of debris that becomes entrapped in magnet case 332. In some of the various embodiments, one or more brackets 334 may be adapted to mechanically couple magnet case 332 to intake portion 228 of pickup head 112 with magnet case 332 disposed rearward of intake portion 228 of pickup head 112 and laterally aligned with one or more rear wheels or tires 108, intake tube 226, or the intake aperture of intake portion 228 of pickup head 112. For example, each bracket 334 may have a length that facilitates mechanically coupling a rear end portion of bracket 334 to the top outer surface of magnet case 332 and a front end portion of bracket 334 to the top outer surface of pickup head 112, with the front end portion of each bracket 334 being spaced apart from the front end portion of each other bracket 334 by a distance that exceeds the width of intake tube 226 or the intake aperture in intake portion 228 of pickup head 112. In some embodiments, each bracket 334 may have a sufficient length to mechanically couple magnet case 332 to pickup head 112 with a gap disposed between magnet case 332 and pickup head 112, thereby facilitating magnet case 332 being positioned entirely rearward of the rearmost portion of rear skirt 442 when truck 100 moves forward.

Figure 7:
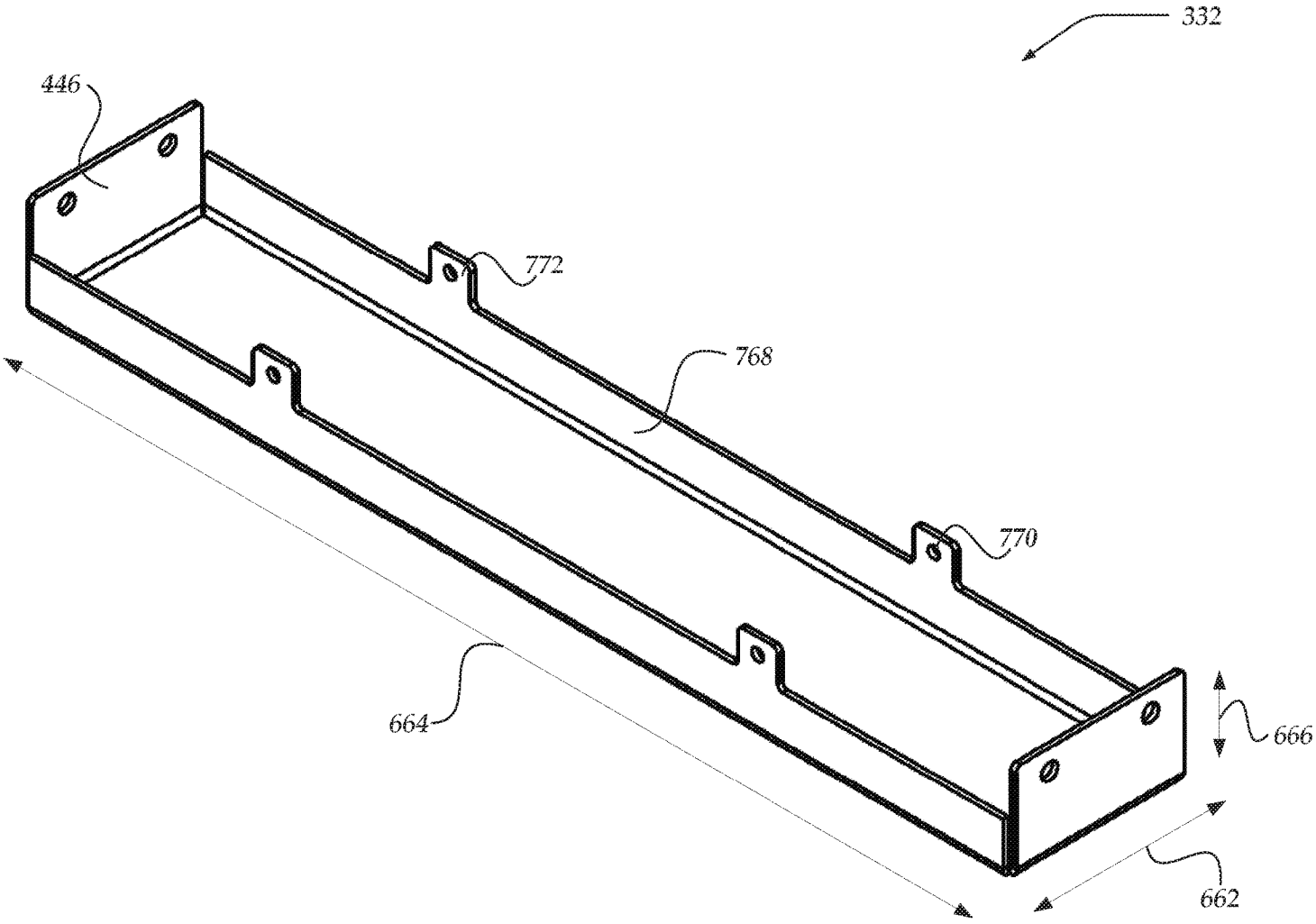
FIG. 7 illustrates a top isometric view of an example base of the magnet bar of FIG. 2.

FIG. 7 illustrates a top isometric view of example base 768 of magnet case 332. In one or more of the various embodiments, one or more end caps 446 may be integral to base 768. In other embodiments, base 768 may be devoid of end caps 446. In some of the various embodiments, base 768 may have one or more base apertures 770. In some embodiments, one or more base apertures 770 may be positioned in one or more side walls or end caps 446 of base 768. In some embodiments, base 768 may have one or more tabs 772 that extend from one or more side walls of base 768, thereby facilitating providing a lighter weight for base 768 in comparison to a base that has side walls that extend upward to the topmost portion of one or more tabs 772. In some embodiments, one or more base apertures 770 may be disposed in one or more tabs 772.

Figure 8:
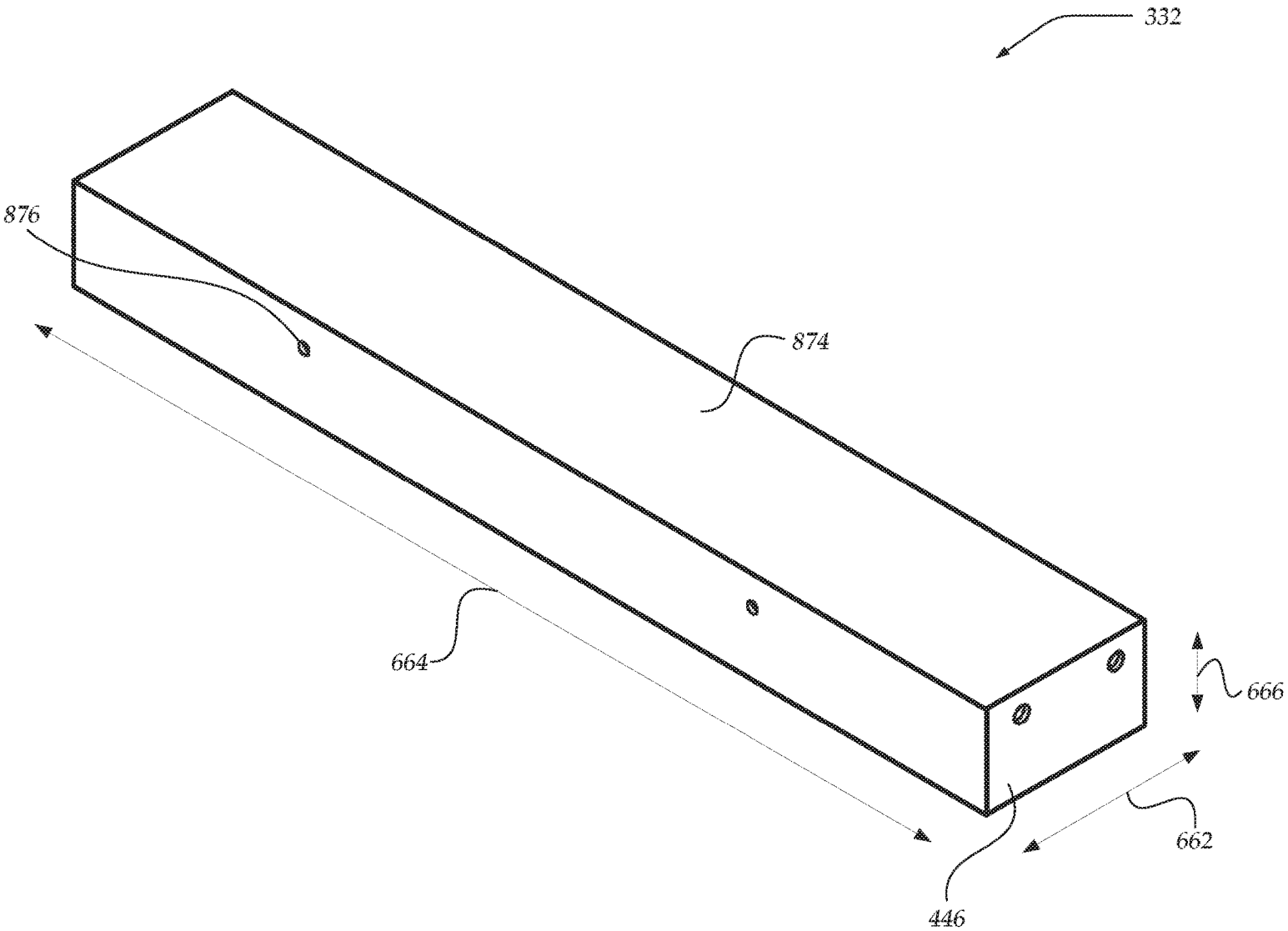
FIG. 8 shows a top isometric view of an example cover of the magnet bar of FIG. 2.

FIG. 8 shows a top isometric view of example cover 874 of magnet case 332. In one or more of the various embodiments, after one or more magnets 548 and, optionally, one or more keeper plates 550 have been positioned in base 708, cover 874 may be positioned over base 768. In some of the various embodiments, one or more end caps 446 may be integral to cover 874. In other embodiments, cover 874 may be devoid of end caps 446. In some embodiments, cover 874 may have one or more cover apertures 876. In some embodiments, one or more cover apertures 874 may be positioned in one or more side walls or end caps 446 of cover 874. In some embodiments, one or more cover apertures 876 may be vertically aligned with one or more corresponding base apertures 770, thereby facilitating one or more case fasteners 336 extending through both one or more cover apertures 876 and one or more base apertures 770.

Figure 9:
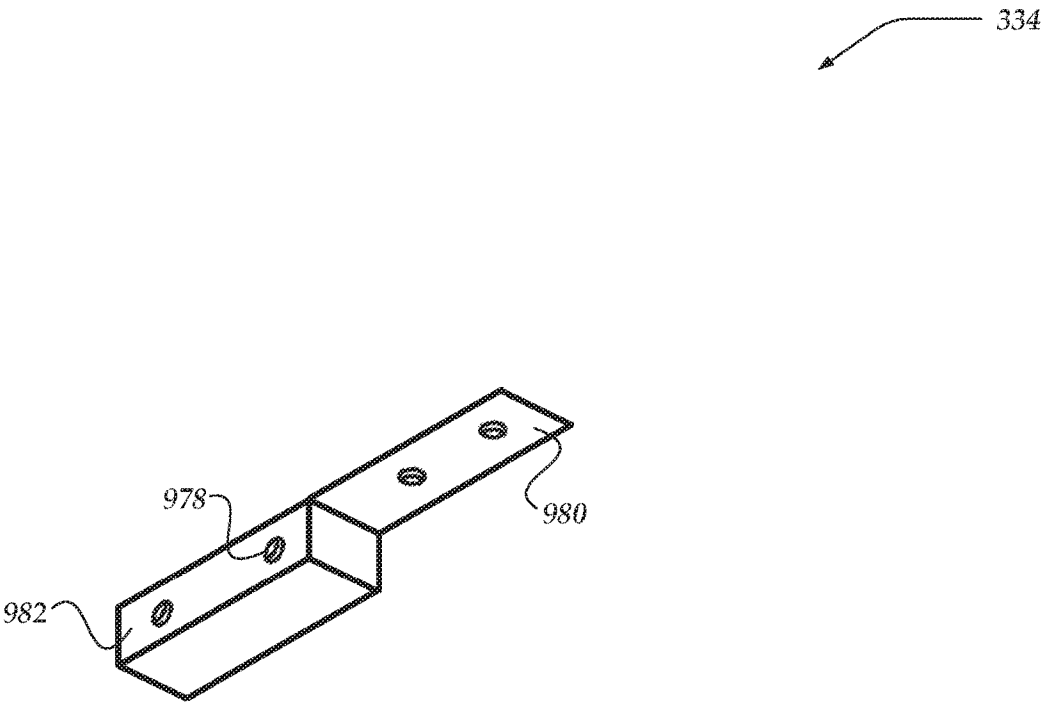
FIG. 9 illustrates a top isometric view of an example bracket of the magnet bar of FIG. 2 for the base of FIG. 7 or the cover of FIG. 8.

FIG. 9 illustrates a top isometric view of example bracket 334 for base 768 or cover 874. In one or more of the various embodiments, one or more brackets 334 may have one or more bracket apertures 978 that are vertically aligned with one or more base apertures 770 or cover apertures 876 in one or more end caps 446, thereby facilitating one or more case fasteners 336 extending through both one or more bracket apertures 978 and one or more base or cover apertures 770, 876 to mechanically couple magnet case 332 to pickup head 112.

As shown in FIG. 9, one or more brackets 334 may be a Z-shaped bracket, thereby facilitating providing vertical alignment or vertical offset between the upper surface of pickup head 112 and the upper surface of magnet case 332. In one or more of the various embodiments, one or more brackets 334 may have horizontal upper surface 980 that mechanically couples to the upper surface of pickup head 112 and vertical lower surface 982 that mechanically couples to the outer surface of one or more end caps 446. In embodiments where one of base 768 or cover 874 has end cap 446 at a lateral end portion and the other of base 768 or cover 874 is devoid of end caps 446 at the lateral end portion, lower surface 982 of bracket 334 may be mechanically coupled to end cap 446 of the one of base 768 or cover 874 before cover 874 is positioned over base 768.

In one or more of the various embodiments, magnet case 332 may include an aluminum rectangular tube, such as a 6063-T52 aluminum rectangular tube. In some of the various embodiments, magnet case 332 may have length 662 of 3, 4, 5, 6, 8, 10, 12, 15, 18, or more inches that extends along the longitudinal length of truck 100. In some embodiments, magnet case 332 may have width 664 of 8, 10, 12, 15, 18, 24, 25, 25.5, 26, 28, 30, 36 or more inches that is transverse to the length of magnet case 332 and that extends along the rear face of pickup head 112. In some embodiments, magnet case 332 may have height 666 of 1, 1.5, 2, 2.5, 3, 4, 6, or more inches that is transverse to length 662 and width 664 of magnet case 332. In some embodiments, one or more walls (for example, one or more of the top, bottom, front, rear, or other walls) of magnet case 332 may have a thickness of 0.1, 0.2, 0.25, 0.3, 0.4, 0.5, or more inches. For example, magnet case 332 may have an internal length of 4.75 inches and an internal height of 1.75 inches.

In one or more of the various embodiments, one or more brackets 334 may have a length of 2, 3, 4, 5, 6, 7, 8, 9, 10, 12, 18, 24, or more inches that extends along the longitudinal length of truck 100. In some of the various embodiments, one or more brackets 334 may have a width of one, 1.25, 1.5, 1.75, 2, 3, 4, 5, 6, 7, 8, 9, 10, or more inches that is transverse to the length of one or more brackets 334 and that extends along the rear face of pickup head 112. In some embodiments, one or more brackets 334 may have a height of 1, 1.25, 1.5, 1.75, 2, 3, or more inches that is transverse to the length and width of one or more brackets 334. In some embodiments, one or more walls (for example, one or more of the bottom, side, or other walls) of one or more brackets 334 may have a thickness of 0.1, 0.125, 0.25, 0.5, 0.75, 1, or more inches.

In one or more of the various embodiments, one or more end caps 446 may have a length of 2, 3, 4, 5, 6, 7, 8, 9, 10, or more inches that extends along the longitudinal length of truck 100. In some of the various embodiments, one or more end caps 446 may have a width of 1, 2, 3, 4, 5, 6, 7, 8, 9, 10, or more inches that is transverse to the length of one or more end caps 446 and that extends along the rear face of pickup head 112. In some embodiments, one or more end caps 446 may have a height of 1, 2, 3, or more inches that is transverse to the length and width of one or more end caps 446. In some embodiments, one or more walls (for example, one or more of the top, bottom, side, or other walls) of one or more end caps 446 may have a thickness of 0.1, 0.125, 0.25, 0.5, 0.75, 1, or more inches.

In one or more of the various embodiments, each magnet 548 may have a length of 1, 2, 3, 4, 5, 6, 7, 8, 9, 10, or more inches that extends along the longitudinal length of truck 100. In some of the various embodiments, each magnet 548 may have a width of 1, 2, 3, 4, 5, 6, 7, 8, 9, 10, or more inches that is transverse to the length of each magnet 548 and that extends along the rear face of pickup head 112. In some embodiments, each magnet 548 may have a height of 0.5, one, 1.5, 2, 3, or more inches that is transverse to the length and width of each magnet 548.

In one or more of the various embodiments, one or more keeper plates 550 or cushions may have a length of 1, 2, 3, 4, 4.25, 4.5, 4.75, 5, 6, 7, 8, 9, 10, or more inches that extends along the longitudinal length of truck 100. In some of the various embodiments, one or more keeper plates 550 or cushions may have a width of 1, 2, 3, 4, 5, 6, 7, 8, 9, 10, or more inches that is transverse to the length of one or more keeper plates 550 or cushions and that extends along the rear face of pickup head 112. In some embodiments, one or more keeper plates 550 or cushions may have a height of 0.1, 0.25, 0.5, 0.75, 1, 1.5, 2, 3, or more inches that is transverse to the length and width of one or more keeper plates 550 or cushions.

The terms "front," "rear," "frontward," and "rearward" are used consistently with respect to all elements and are defined relative to front end portion 102 of truck 100. Front end portion 102 of truck 100 faces the direction that truck 100 travels in ordinary use. The terms "longitude," "longitudinal," "lateral," "width," and "height" are also used consistently with respect to all elements and are defined relative to the longitudinal axis of truck 100. The longitudinal axis of truck 100 extends from front end portion 102 to rear end portion 104 of truck 100. The lateral axis of truck 100 is perpendicular to the longitudinal axis of truck 100. The width of truck 100 is transverse to the longitudinal axis of truck 100 (for example, parallel to the lateral axis of truck 100) and, when parked on a flat surface, is parallel to the flat surface. The height of truck 100 is transverse to the longitudinal axis and the width of truck 100.

The foregoing examples should not be construed as limiting or exhaustive, yet rather, illustrative use cases to show implementations of at least one of the various embodiments of the invention. Accordingly, many changes can be made without departing from the spirit and scope of the invention. For example, although FIGS. 1 and 2 show blower side portion 118 as being the left side portion of truck 100 and intake side portion 228 as being the right side portion of truck 100, these positions may be reversed with intake side portion 228 being the left side portion of truck 100 and blower side portion 118 being the right side portion of truck 100. As another example, intake side portion 228 may be both the right and left side portions of truck 100 with blower portion 118 being in the middle, or intake portion 228 may be in the middle with blower portion 118 being both the right and left side portions of truck 100. Thus, the scope of the invention is not limited by the disclosure of the examples. Instead, the invention should be determined entirely by reference to the claims that follow.

The embodiments of the invention in which an exclusive property or privilege is claimed are defined as follows:

1. A street sweeper vehicle for traveling over a ground surface and having a forward end and a rearward end, the forward end being in the direction of forward driving of the vehicle, the street sweeper vehicle comprising:

a hopper;

a vacuum pickup head having an intake portion that is fluidly coupled to the hopper;

a magnet bar disposed rearward of the intake portion of the pickup head, the magnet bar positioned to attract debris that is not pulled into the air and picked up by the vacuum pickup head, and a rear tire disposed rearward of the pickup head, wherein the magnet bar is disposed forward of the rear tire and is laterally aligned with the rear tire such that the magnet bar is directly between the intake portion of the pickup head and the rear tire of the street sweeper in a fore-aft direction.

2. The street sweeper of claim 1, wherein the magnet bar is mechanically coupled to the pickup head.

3. The street sweeper of claim 1, wherein the pickup head has a width, and the magnet bar has a width that is less than half the width of the pickup head.

4. The street sweeper of claim 1, further comprising one or more rear wheels disposed rearward of the pickup head and laterally aligned with the intake portion of the pickup head, the one or more rear wheels having a combined width, wherein the magnet bar is disposed forward of the one or more rear wheels, is laterally aligned with the one or more rear wheels, and has a width that is less than double the combined width of the one or more rear wheels.

5. The street sweeper of claim 1, wherein the pickup head has a blower portion that is fluidly coupled to a blower, and the blower portion of the pickup head lacks the magnet bar.

6. The street sweeper of claim 1, wherein the magnet bar comprises:

a magnet case;

a magnet disposed in the magnet case;

a bracket mechanically coupled to the magnet case and to the intake portion of the pickup head with the magnet case disposed rearward of the intake portion of the pickup head.

7. The street sweeper of claim 1, wherein magnet bar comprises:

a magnet case;

a magnet disposed in the magnet case;

a bracket mechanically coupled to the magnet case and to the intake portion of the pickup head with the magnet case disposed rearward of the intake portion of the pickup head; and an end cap disposed at a lateral end portion of the magnet case, one or more portions of the end cap being aligned with one or more portions of the bracket.

8. The street sweeper of claim 1, wherein magnet bar comprises:

a magnet case;

a magnet disposed in the magnet case;

a bracket mechanically coupled to the magnet case and to the intake portion of the pickup head with the magnet case disposed rearward of the intake portion of the pickup head;

an end cap disposed at a lateral end portion of the magnet case; and a case fastener that mechanically couples the bracket and the end cap.

9. The street sweeper of claim 1, wherein magnet bar comprises:

a magnet case;

an array of magnets disposed in the magnet case; and a keeper plate disposed in the magnet case and magnetically coupled to each magnet in the array of magnets.

10. A magnet bar for a street sweeper for traveling over a paved ground surface, the street sweeper having a pickup head pulling a vacuum, the pickup head having a forward side and a rearward side, the magnet bar comprising:

a magnet case;

a magnet disposed in the magnet case; and a bracket mechanically coupled to the magnet case and adapted to mechanically couple the magnet case to an intake portion of the pickup head of the street sweeper with the magnet case disposed rearward of the intake portion of the pickup head, the bracket having a first attachment point and a second attachment point on a lower surface of the bracket, the magnet being secured to the first attachment point, the second attachment point being adapted to secure to an upper surface of the pickup head, the bracket positioning the magnet to attract ferrous debris that is not pulled into the air and picked up by the pickup head.

11. The magnet bar of claim 10, wherein the intake portion of the pickup head has an intake aperture, and the bracket is adapted to mechanically couple the magnet case to the intake portion of the pickup head with the magnet case laterally aligned with the intake aperture of the intake portion of the pickup head.

12. The magnet bar of claim 10, wherein the pickup head has a width, and the magnet case has a width that is less than half the width of the pickup head.

13. The magnet bar of claim 10, wherein the street sweeper has a rear wheel disposed rearward of the pickup head, and the bracket is adapted to mechanically couple the magnet case to the intake portion of the pickup head with the magnet case laterally aligned with the rear wheel.

14. The magnet bar of claim 10, wherein the street sweeper has one or more rear wheels disposed rearward of the pickup head and laterally aligned with the intake portion of the pickup head, the one or more rear wheels having a combined width, and the magnet case has a width that is less than double the combined width of the one or more rear wheels.

15. The magnet bar of claim 10, further comprising an end cap disposed at a lateral end portion of the magnet case, one or more portions of the end cap being aligned with one or more portions of the bracket.

16. The magnet bar of claim 10, further comprising:

an end cap disposed at a lateral end portion of the magnet case; and a case fastener that mechanically couples the bracket and the end cap.

17. The magnet bar of claim 10, further comprising:

another magnet disposed in the magnet case, the magnet and the other magnet being arranged in an array of magnets; and a keeper plate disposed in the magnet case and magnetically coupled to each magnet in the array of magnets.

18. The magnet bar of claim 10, further comprising a cushion disposed in the magnet case, the cushion being in physical contact with the magnet.

* * * * *